US006341595B1

(12) United States Patent
Scollard et al.

(10) Patent No.: US 6,341,595 B1
(45) Date of Patent: Jan. 29, 2002

(54) LASER WELDED FUEL RAIL AND PROCESS OF MAKING SAME

(75) Inventors: Joseph Edward Scollard, Suffolk; James Russell Morris, Newport News; Jeffery Ersin Brittle, Williamsburg; Dean Leigh Spiers, Yorktown, all of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/606,539

(22) Filed: Jun. 30, 2000

Related U.S. Application Data

(60) Provisional application No. 60/165,390, filed on Nov. 12, 1999.

(51) Int. Cl.[7] ..... F02M 55/02
(52) U.S. Cl. ..... 123/456; 123/469
(58) Field of Search ..... 123/456, 468, 123/469, 470

(56) References Cited

U.S. PATENT DOCUMENTS

| | | | | |
|---|---|---|---|---|
| 4,474,160 A | | 10/1984 | Gartner | 123/468 |
| 4,519,368 A | | 5/1985 | Hudson, Jr. | 123/468 |
| 4,649,884 A | * | 3/1987 | Tuckey | 123/457 |
| 4,751,904 A | | 6/1988 | Hudson, Jr. | 123/470 |
| 5,024,198 A | * | 6/1991 | Usui | 123/468 |
| 5,080,069 A | * | 1/1992 | Hudson, Jr. | 123/456 |
| 5,090,385 A | * | 2/1992 | Usui et al. | 123/468 |
| 5,577,478 A | | 11/1996 | Tuckey | 123/456 |
| 5,771,863 A | | 6/1998 | Daly | 123/456 |

* cited by examiner

*Primary Examiner*—Willis R. Wolfe
*Assistant Examiner*—Hai Huynh

(57) ABSTRACT

A fuel rail for a fuel injection system is disclosed. The fuel rail includes a first portion including a generally elongated base, at least one mounting bracket and a plurality of fuel cup openings in the generally elongated base. The fuel rail also comprises a second, generally U-shaped, portion having a first and second opposing sides. Each of the first and second opposing sides are sealingly connected to the generally elongated base with a laser weld. The second portion also has a supply end having a fuel supply opening, and a closed end, distal from the supply end. The closed end and the supply end are sealingly connected to the generally elongated base with a laser weld. A method of manufacturing the fuel rail is also disclosed.

17 Claims, 4 Drawing Sheets

LASER WELDED FUEL RAIL AND PROCESS OF MAKING SAME

CROSS-REFERENCE TO RELATED APPLICATION

The present application claims priority from U.S. Provisional Application Ser. No. 60/165,390, filed Nov. 12, 1999.

FIELD OF THE INVENTION

The present invention relates to fuel rails for internal combustion engines.

BACKGROUND OF THE INVENTION

Previously, known fuel rails have been formed from low carbon tubular steel. The steel tube was then pierced in several predetermined locations to allow other components to be inserted into the tube, such as fuel cups, hose fittings, and other tubes. At this point, mounting brackets were spot welded onto the tube. A copper paste was applied to joints between the components and the tube. The tube and the attached components were then sent through a brazing furnace to melt the copper at each joint, forming a hermetic, leak-proof seal. This brazing process caused several problems. First, during brazing, the entire tube would severely warp, requiring the tube or the components to be bent into proper position later in the manufacturing process, adding extra steps to the manufacturing process. Second, the brazing process was somewhat unreliable, resulting in leaks in the brazed joints.

To the inventors' knowledge, other fuel rails have been formed from two shells which are brazed together, but these rails suffer the same deficiencies as described above.

It would be beneficial to develop a fuel rail which does not warp during manufacture, and in which a tight seal can be formed between components.

BRIEF SUMMARY OF THE INVENTION

Briefly, the present invention provides a fuel rail. The fuel rail comprises a first portion including a generally elongated base, at least one mounting bracket and a plurality of fuel cup openings in the generally elongated base. The fuel rail also comprises a second, generally U-shaped, portion having a first and second opposing sides. Each of the first and second opposing sides are sealingly connected to the generally elongated base with a laser weld. The second portion also has a supply end having a fuel supply opening, and a closed end, distal from the supply end. The closed end and the supply end are sealingly connected to the generally elongated base with a laser weld.

The present invention also provides a fuel rail assembly. The fuel rail assembly comprises a fuel supply header having a discharge end and a fuel rail connected to the discharge end of the fuel supply header. The fuel rail includes a first portion including a generally elongated base, at least one mounting bracket and a plurality of fuel cup openings in the generally elongated base. The fuel rail also includes a second, generally U-shaped, portion having a first and second opposing sides. Each of the first and second opposing sides is sealingly connected to the generally elongated base with a laser weld. The second portion also has a supply end having a fuel supply opening, and a closed end, distal from the supply end. The closed end and the supply end are sealingly connected to the generally elongated base with a laser weld. The assembly also includes a plurality of fuel injectors, with each of the plurality of fuel injectors being connected to a fuel cup opening, The present invention also provides a method of manufacturing a fuel rail. The method comprises forming a first portion having at least one integral mounting bracket; a deep drawing a second, generally U-shaped portion having first and second opposing sides, a closed end and a supply end; and sealingly connecting the first and second opposing sides, the closed end, and the supply end to the first portion.

BRIEF DESCRIPTION OF THE DRAWINGS

The accompanying drawings, which are incorporated herein, and constitute part of this specification, illustrate the presently preferred embodiment of the invention, and, together with the general description given above and the detailed description given below, serve to explain the features of the invention. In the drawings.

DETAILED DESCRIPTION OF THE PREFERRED EMBODIMENT

Figure 1:
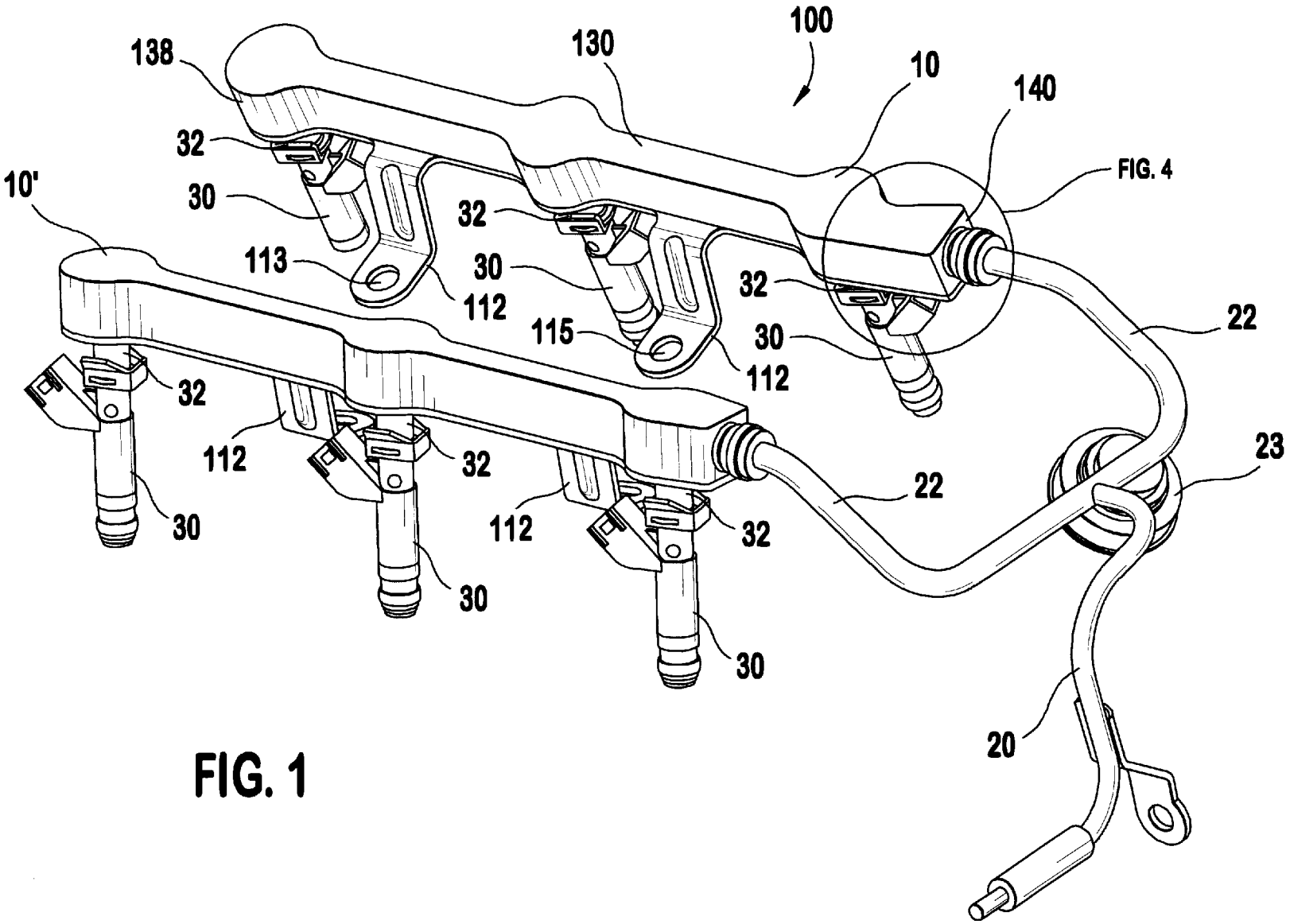
FIG. 1 is a perspective view of two fuel rails according to a preferred embodiment of the present invention, with a fuel supply header and a plurality of fuel injectors connected to each fuel rail.

Referring to FIG. 1, fuel rails 10, 10' according to a preferred embodiment are shown, with a fuel supply header 20 and three fuel injectors 30 connected to the fuel rail 10. In the drawings, like numbers indicate like elements throughout. The fuel rails 10, 10', together with the fuel supply header 20 and fuel injectors 30, form a fuel supply assembly 100. The fuel supply header 20 splits into two fuel supply lines 22, with each fuel supply line 22 supplying fuel to a separate fuel rail 10 and 10'. A fuel pressure regulator 23 is located in the fuel supply header 20 where the fuel supply lines 22 split. Fuel rails 10 and 10' are preferably mirror images of each other, and only fuel rail 10 will be described herein. Those skilled in the art will recognize that the present description pertains to fuel rail 10' as well.

Figure 2:
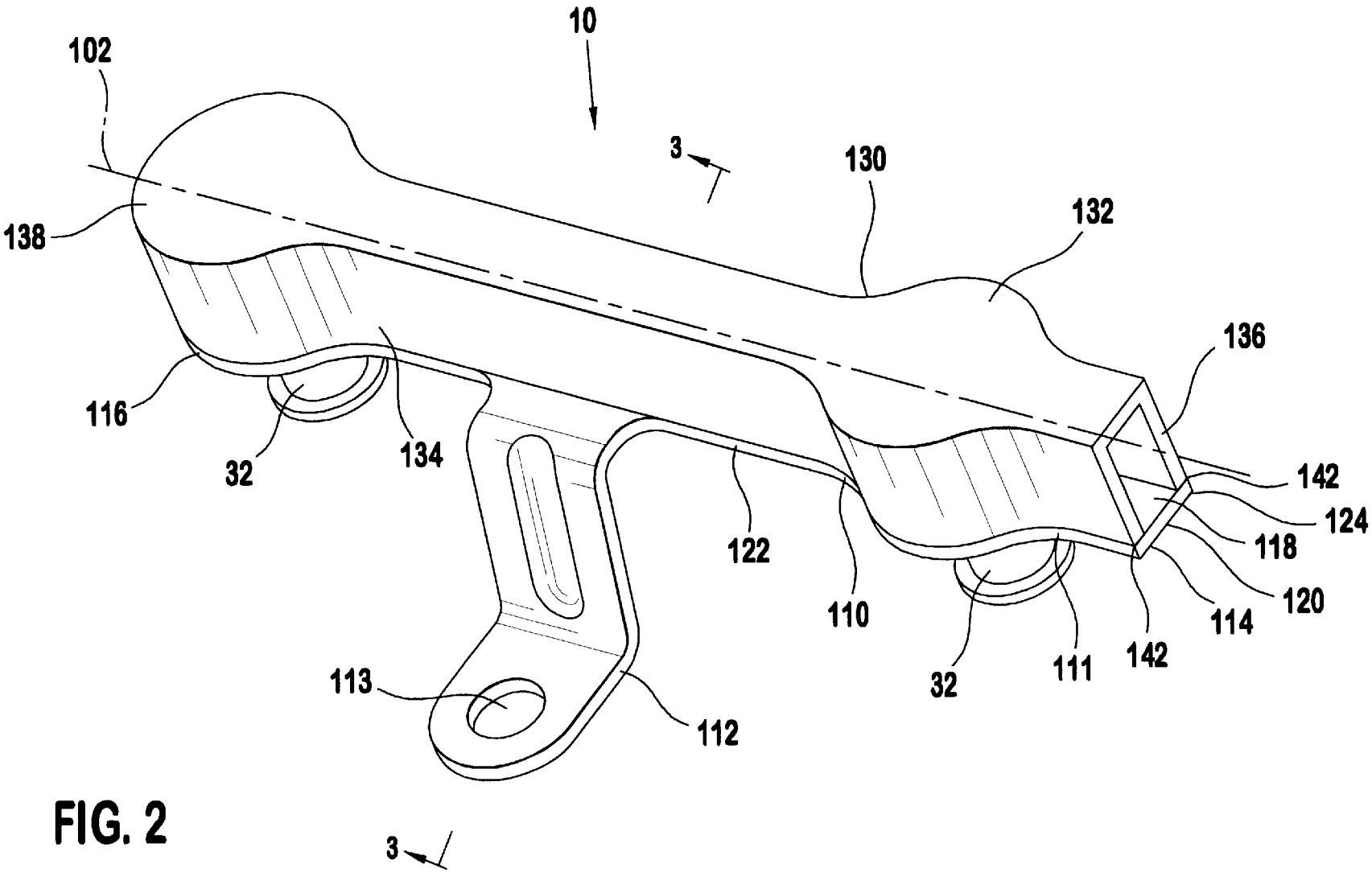
FIG. 2 is an enlarged perspective view of a portion of the fuel rail shown in FIG. 1.

Referring now to FIG. 2, which shows the fuel rail 10 only, the fuel rail 10 is constructed of two portions, a first, or lower portion 110, and a second, or upper portion 130. The fuel rail 10 includes a longitudinal axis 102 extending therethrough.

The lower portion 110 is preferably formed from stainless steel and includes a generally elongated base 111 and at least one, and preferably two, integrated mounting brackets 112. Preferably, the lower portion 110 is stamped from a single sheet of material. A base 111 having an integrated mounting bracket 112 which can be incorporated into the present invention is disclosed in U.S. patent application Ser. No. 09/606,538, filed on even date, which is incorporated herein in its entirety by reference.

The base 111 is generally planar and includes a first end 114, a second end 116, a top face 118, an opposing bottom face 120, a first longitudinal side 122 and a second longitudinal side 124. The base 111 includes a plurality of injector cups 32 which extend down from the bottom face 120 and connect to each of the fuel injectors 30. The injector cups 32 provide for fluid communication between the interior of the fuel rail 10 and the fuel injectors 30. Preferably, the injector cups 32 are deep drawn, which is well known to those skilled in the art.

Each mounting bracket 112 is integrally formed with the base 111 and is formed from the same sheet of material as the base 111. Preferably, each mounting bracket 112 extends from the first longitudinal side 122, although those skilled in the art will recognize that a mounting bracket 112 can extend from the second longitudinal side 124 or either of the first and second ends 114, 116, respectively. Each mounting bracket 112 preferably includes at least one through hole 113 through which a mounting bolt (not shown) can be inserted to attach the fuel rail 10 to a surface, such as an engine block (not shown).

The upper portion 130 is preferably formed by deep drawing a sheet of material into a generally inverted U-shape. Preferably, the upper portion 130 is formed from stainless steel, although those skilled in the art will recognize that the upper portion 130 can be formed from other suitable materials. The upper portion 130 includes a top surface 132, first and second opposing sides 134, 136, respectively, which are generally parallel to the longitudinal axis 102, a closed end 138 and an open, or supply, end 140, distal from the closed end 138. The first and second sides 134, 136 are each located along the first and second longitudinal sides 122, 124, respectively, of the lower portion 110 such that the first and second sides 134, 136 and the closed end 138 of the upper portion 130 rest on the top face 118 of the lower portion 110, forming a butt joint between the lower portion 110 and the upper portion 130.

Figure 3:
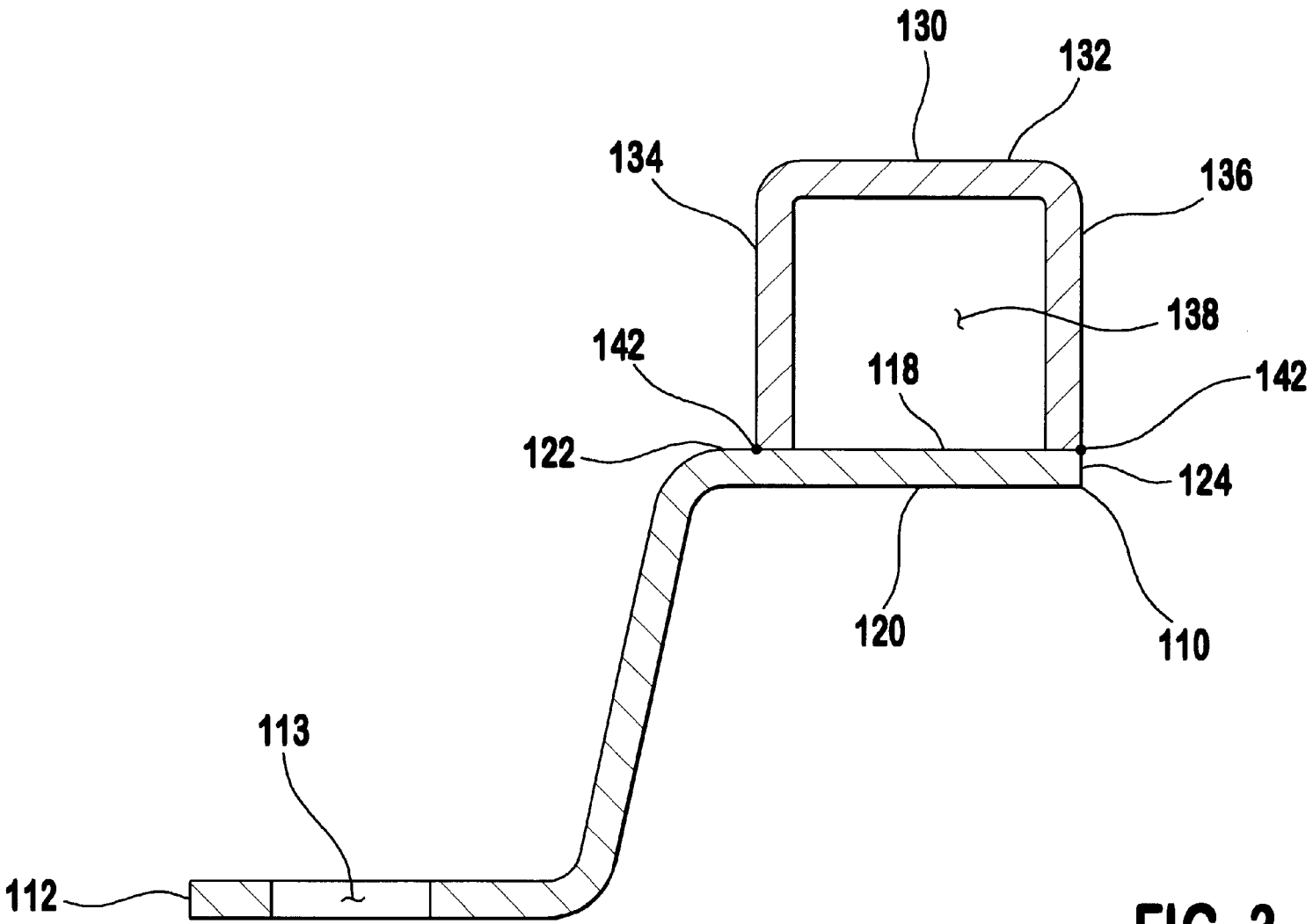
FIG. 3 is a sectional view of the fuel rail taken along line 3—3 of FIG. 2.

With the upper portion 130 engaging the lower portion 110, as shown in FIG. 3, the upper portion 130 is fixedly connected to the lower portion with a laser weld 142.

The laser weld 142 is provided around the entire fuel rail 10 where the upper portion 130 and the lower portion 110 contact, providing a hermetic seal between the upper portion 130 and the lower portion 110.

Figure 4:
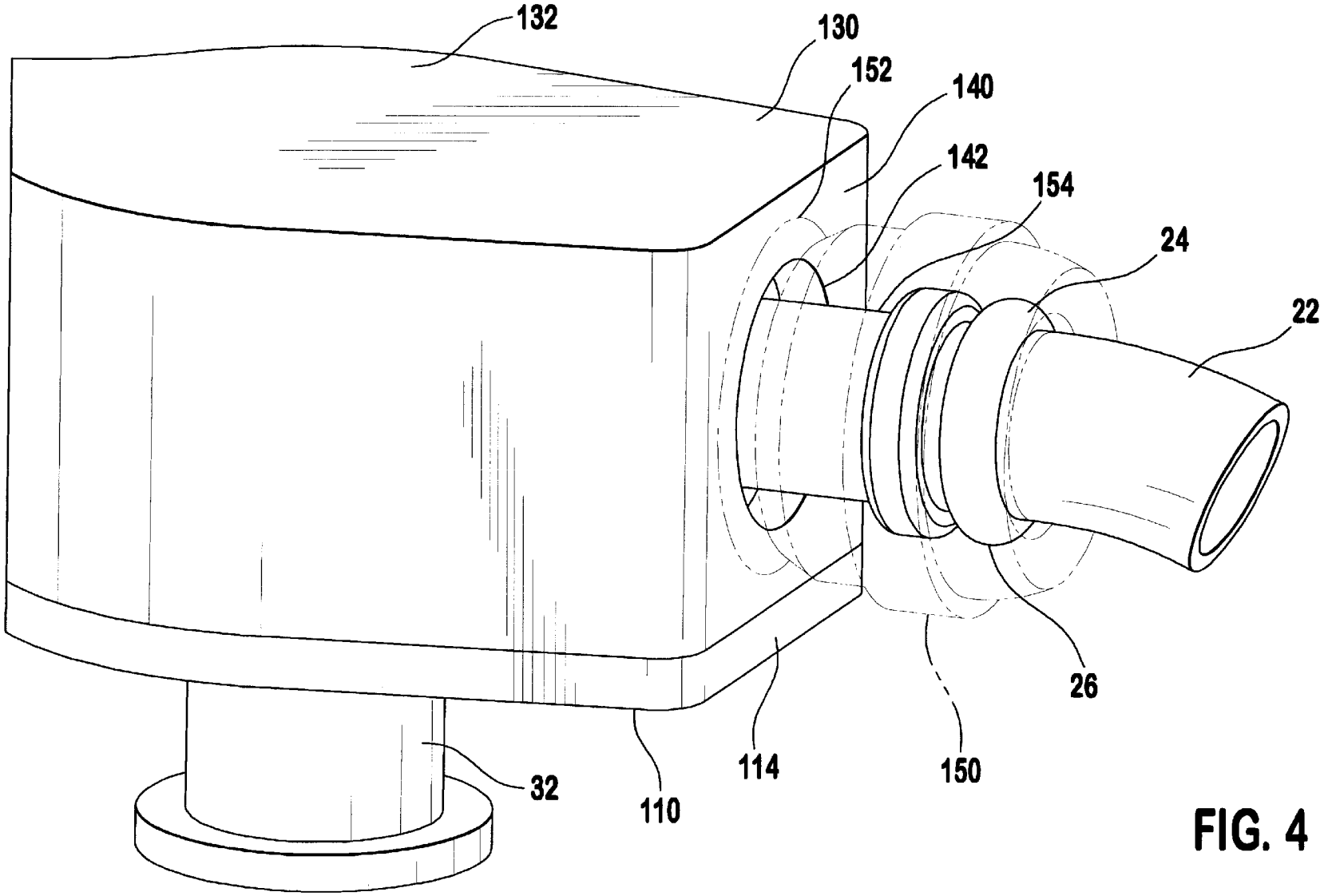
FIG. 4 is an enlarged perspective view of an interface between the fuel rail and a fuel supply line.

As shown in FIG. 4, the supply end 140 of the upper portion 130 includes an opening 142 extending therethrough which fluidly communicates the fuel supply line 22 with the interior of the fuel rail 10. The supply end 140 of the upper portion 130 also includes a swivel fitting 150 (shown in dashed lines in FIG. 4) which is laser welded into the opening 142. The swivel fitting 150 includes a welded end 152 and a free end 154. The fuel supply line 22 has a discharge end 24 which is generally tubular in shape. The discharge end 24 includes an o-ring 26 or other sealing device on the outer diameter of the discharge end 24. The discharge end 24 and the o-ring 26 are sized to be inserted into the free end 154 of the swivel fitting 150. After the discharge end 24 and the o-ring 26 are inserted into the free end 154 of the swivel fitting 150, the free end 154 of the swivel fitting 150 is rolled over, or crimped to the discharge end 24 to secure the supply line 22 with the o-ring 26 onto the swivel fitting 150. The supply line 22 is free to rotate about the longitudinal axis 102, allowing for better alignment and installation of the supply line 22 with the fuel rail 10.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined in the appended claims.

What is claimed is:

1. A fuel rail comprising:

a first portion including a generally elongated base, at least one mounting bracket and a plurality of fuel cup openings in the generally elongated base; and a second, generally U-shaped, portion having a first and second opposing sides, each of the first and second opposing sides being sealingly connected to the generally elongated base with a laser weld, the second portion also having a supply end having a fuel supply opening, and a closed end, distal from the supply end, the closed end and the supply end being sealingly connected to the generally elongated base with a laser weld.

2. The fuel rail according to claim 1, wherein the first portion is stamped.

3. The fuel rail according to claim 1, wherein the second portion is deep drawn.

4. The fuel rail according to claim 1, wherein the laser weld is a butt weld.

5. The fuel rail according to claim 1, wherein the mounting bracket is integrally formed with the generally elongated base.

6. A fuel rail assembly comprising:

a fuel supply header having a discharge end;

a fuel rail connected to the discharge end of the fuel supply header, the fuel rail including:

a first portion including a generally elongated base, at least one mounting bracket and a plurality of fuel cup openings in the generally elongated base;

and a second, generally U-shaped, portion having a first and second opposing sides, each of the first and second opposing sides being sealingly connected to the generally elongated base with a laser weld, the second portion also having a supply end having a fuel supply opening, and a closed end, distal from the supply end, the closed end and the supply end being sealingly connected to the generally elongated base with a laser weld; and a plurality of fuel injectors, each of the plurality of fuel injectors being connected to a fuel cup opening.

7. The fuel rail according to claim 6, wherein the first portion is stamped.

8. The fuel rail according to claim 6, wherein the second portion is deep drawn.

9. The fuel rail according to claim 6, wherein the laser weld is a butt weld.

10. The fuel rail according to claim 6, wherein the mounting bracket is integrally formed with the generally elongated base.

11. The fuel rail according to claim 6, wherein the fuel rail is connected to the discharge end of the fuel supply header with a swivel joint.

12. The fuel rail according to claim 6, wherein the swivel joint comprises a swivel fitting laser welded to the supply end of the second portion, the swivel fitting being crimped onto the discharge end of the fuel supply header.

13. The fuel rail according to claim 6, wherein the fuel supply header comprises a fuel pressure regulator.

14. A method of manufacturing a fuel rail comprising:

forming a first portion having at least one integral mounting bracket;

deep drawing a second, generally U-shaped portion having first and second opposing sides, a closed end and a supply end; and laser welding the first and second opposing sides, the closed end, and the supply end to the first portion.

15. The method according to claim 14, wherein laser welding the first and second opposing sides, the closed end and the supply end to the first portion comprises butt joining the first and second opposing sides, the closed end and the supply end to the first portion.

16. The method according to claim 14, wherein forming the first portion comprises stamping.

17. The method according to claim 16, wherein forming the first portion further comprises deep drawing a plurality of cups.

* * * * *